US008058968B2

(12) United States Patent
Hirano et al.

(10) Patent No.: US 8,058,968 B2
(45) Date of Patent: Nov. 15, 2011

(54) METHOD FOR MANUFACTURING RECTANGULAR PLATE TYPE CHIP RESISTOR AND RECTANGULAR PLATE TYPE CHIP RESISTOR

(75) Inventors: Tatsuki Hirano, Ayase (JP); Osamu Matsukawa, Ayase (JP)

(73) Assignee: Kamaya Electric Co., Ltd., Ayase-shi (JP)

( * ) Notice: Subject to any disclaimer, the term of this patent is extended or adjusted under 35 U.S.C. 154(b) by 281 days.

(21) Appl. No.: 12/376,878

(22) PCT Filed: May 18, 2007

(86) PCT No.: PCT/JP2007/060234

§ 371 (c)(1),
(2), (4) Date: Feb. 9, 2009

(87) PCT Pub. No.: WO2008/018219

PCT Pub. Date: Feb. 14, 2008

(65) Prior Publication Data

US 2010/0176913 A1 Jul. 15, 2010

(30) Foreign Application Priority Data

Aug. 10, 2006 (JP) ..... 2006-218378

(51) Int. Cl.
*H01C 1/012* (2006.01)

(52) U.S. Cl. ..... 338/309; 338/332; 438/382

(58) Field of Classification Search ..... 338/307–309; 29/610.1; 257/359; 438/382–384
See application file for complete search history.

(56) References Cited

U.S. PATENT DOCUMENTS

| | | | | |
|---|---|---|---|---|
| 5,287,083 | A | 2/1994 | Person et al. | |
| 5,339,068 | A * | 8/1994 | Tsunoda et al. | 338/332 |
| 6,108,184 | A * | 8/2000 | Minervini et al. | 361/111 |
| 6,124,769 | A * | 9/2000 | Igarashi et al. | 333/172 |
| 7,326,999 | B2 * | 2/2008 | Tsukada | 257/359 |
| 7,782,174 | B2 * | 8/2010 | Urano | 338/309 |
| 2006/0205171 | A1 | 9/2006 | Tsukada | |
| 2008/0094169 | A1 * | 4/2008 | Kinoshita et al. | 338/309 |

FOREIGN PATENT DOCUMENTS

| | | | |
|---|---|---|---|
| CN | 1433030 | A | 7/2003 |
| CN | 1774771 | A | 5/2006 |
| JP | 6020802 | A | 1/1994 |
| JP | 2000114009 | A | 4/2000 |
| JP | 2000232009 | A | 8/2000 |
| JP | 2003115401 | A | 4/2003 |
| JP | 2004319787 | A | 11/2004 |
| JP | 200788161 | * | 4/2007 |

* cited by examiner

*Primary Examiner* — Kyung Lee
(74) *Attorney, Agent, or Firm* — Jason D. Voight

(57) ABSTRACT

A method for manufacturing rectangular plate type chip resistors and a rectangular plate type chip resistor obtained by this method. The method includes the steps of (A) providing a resistive alloy plate strip of predetermined width and thickness, (B) forming an insulating protective film of a predetermined width longitudinally along the middle of upper and lower faces of the alloy plate strip, (C) forming an electrode layer composed of integrated surface, back, and end electrodes, along both sides of the protective film by electroplating, and (D) cutting the alloy plate strip coated with the protective films and the electrode layers in step (C) transversely in predetermined lengths, wherein resistance is controlled to be within a predetermined range by adjusting the thickness of the alloy plate strip in step (A), the width of the protective film formed in step (B), and the cutting length in step (D).

5 Claims, 1 Drawing Sheet

METHOD FOR MANUFACTURING RECTANGULAR PLATE TYPE CHIP RESISTOR AND RECTANGULAR PLATE TYPE CHIP RESISTOR

This is the National Stage of International Application PCT/JP2007/060234, filed May 18, 2007.

FIELD OF ART

The present invention relates to a method for manufacturing rectangular plate type chip resistors which provides easy and convenient control of resistance, and easy and low cost manufacture of rectangular plate type chip resistors having a highly reliable electrode structure, and to a rectangular plate type chip resistor obtained by such a method and particularly useful in low resistance.

BACKGROUND ART

Chip resistors are generally manufactured by forming resistive films and electrode layers on an insulated substrate by printing or the like process, and cutting crisscross or punching the substrate. In this case, the final adjustment of resistance is often made by providing a slit or a slot in the resistive film.

Patent Publications 1 and 2 propose rectangular plate type chip resistors wherein the insulating substrate is not used, and instead a resistive alloy plate of a certain thickness is provided with electrode layers.

In the method of manufacturing chip resistors disclosed in Patent Publication 1, an insulating layer is formed at a plurality of positions on the upper and lower faces of a resistive metal plate, a surface electrode layer and a back electrode layer are formed along both sides of each insulating layer, and the resistive alloy plate is cut in parallel to the insulating layer, which cutting requires an expensive metal mold. Then an end electrode is required to be formed by soldering along both sides of the cut alloy plate, and after this, the alloy plate is further required to be cut in the transverse direction of the insulating layer for obtaining rectangular plate type chip resistors. As such, in the manufacturing method disclosed in Publication 1 wherein the end electrodes are formed after the first cutting step and then another cutting step is performed, the production process tends to be complex. In addition, since the end electrode cannot be formed together with the surface and back electrodes, the chip resistors manufactured by such a method have different thickness and materials of electrodes, so that the adhesion of the electrodes and the reliability of the electrode structure are not always sufficient.

Patent Publication 2 discloses that, in order to adjust the resistance of the disclosed rectangular plate type chip resistor to a predetermined value, a plurality of slots or slits need to be formed in the resistor element. This publication is silent about a convenient method of manufacturing chip resistors which enables adjustment of resistance without forming such slits and the like.

Patent Publication 1: JP-2004-319787-A

Patent Publication 2: JP-7-38321-B

SUMMARY OF THE INVENTION

It is an object of the present invention to provide a method for manufacturing rectangular plate type chip resistors which provides easy and convenient control of resistance, and easy and low cost manufacture of rectangular plate type chip resistors having an electrode structure of promising reliability, as well as to provide a rectangular plate type chip resistor obtained by such a method and having excellent properties particularly at low resistance.

It is another object of the present invention to provide a method for manufacturing rectangular plate type chip resistors which improves adhesion of the electrodes, and provides easy and efficient manufacture of resistors having resistance controlled to a desired value.

According to the present invention, there is provided a method for manufacturing rectangular plate type chip resistors comprising the steps of:

(A) providing a resistive alloy plate strip of predetermined width and thickness, (B) forming an insulating protective film of a predetermined width longitudinally along the middle of upper and lower faces of said alloy plate strip, (C) forming an electrode layer composed of integrated surface, back, and end electrodes, along both sides of the protective film by electroplating, and (D) cutting the alloy plate strip coated with the protective films and the electrode layers in step (C) transversely in predetermined lengths, wherein the resistance is controlled to be within a predetermined range by adjusting said thickness of the alloy plate strip in step (A), said width of the protective film formed in step (B), and said cutting length in step (D).

According to the present invention, there is also provided a rectangular plate type chip resistor manufactured by the above method, comprising a resistive alloy plate, an insulating protective film on upper and lower faces of said alloy plate, and an electrode portion formed in layers of a substantially uniform thickness on both sides of said protective film and composed of integrated surface, back, and end electrodes, wherein said chip resistor is free of any slit or slot for adjustment of resistance.

The method for manufacturing rectangular plate type chip resistors according to the present invention, which includes steps (A) to (D) mentioned above, provides rectangular plate type chip resistors having a highly reliable electrode structure easily at low cost. The resistance is controlled to be within a predetermined range by a simple process, i.e., by adjusting the thickness of the alloy plate strip in step (A), the width of the protective film formed in step (B), and the cutting length in step (D). Thus no slit or slot is required to be formed for adjusting the resistance, which allows efficient manufacture of reliable chip resistors at low cost.

The rectangular plate type chip resistor according to the present invention has integrated surface, back, and end electrodes formed as a layer of a substantially uniform thickness on both sides of the insulating protective film. Thus the structure of the electrode portion is reliable, the resistance and the temperature coefficient of resistance (TCR) are also reliable, and the resistor is useful in the resistance range of 0.5 to 30 mΩ, in particular of 1 to 15 mΩ.

DESCRIPTION OF REFERENCE SIGNS

10: resistive alloy plate strip

11*a*, 11*b*: insulating protective film

12*a*: surface electrode

Figure 1:
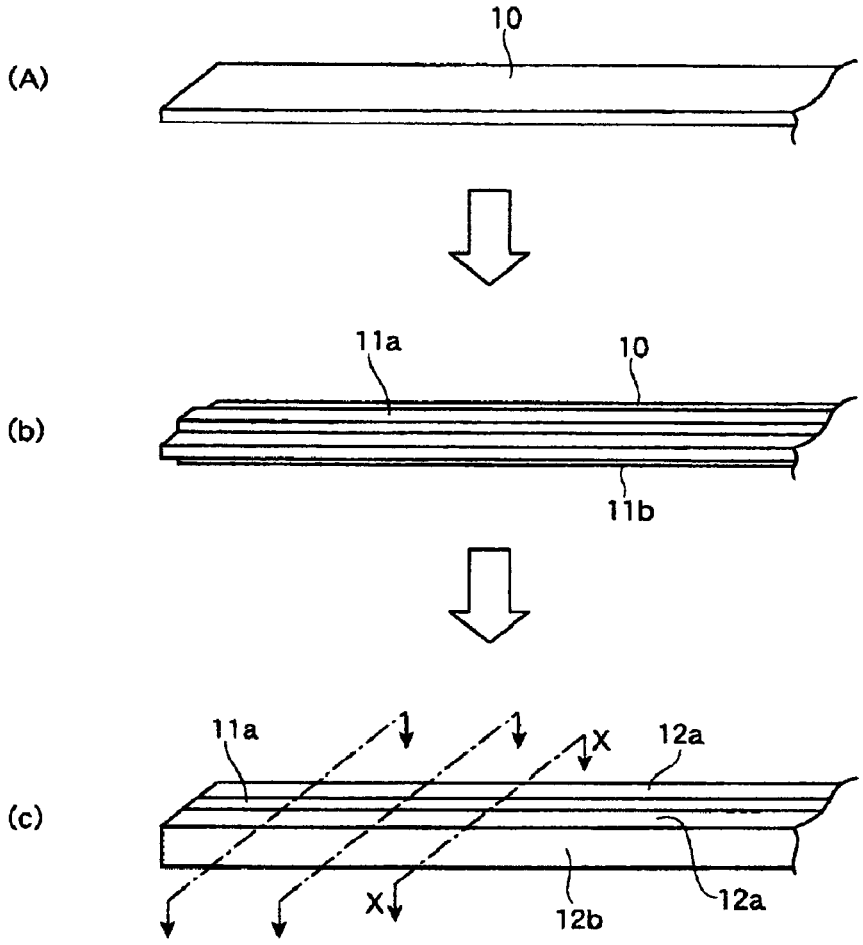
FIG. 1 is a schematic explanatory view for explaining each step of the manufacturing method according to the present invention.

12*b*: end electrode
12*c*: back electrode

PREFERRED EMBODIMENTS OF THE INVENTION

The present invention will now be explained in detail.

According to the manufacturing method of the present invention, first, step (A) of providing a resistive alloy plate strip of predetermined width and thickness is performed.

The alloy for preparing the resistive alloy plate strip may be a conventional resistive alloy, for example, copper based alloys, such as copper-nickel, manganese-copper-nickel, or copper-manganese-tin based alloys; nickel-chromium based alloys, or iron-chromium based alloys. Copper based alloys or iron-chromium based alloys are particularly preferred in view of the adhesion of the electrode portion and reliability at low resistance to be discussed later.

The predetermined width and thickness of the resistive alloy plate strip may suitably be selected depending on the desired resistance. In particular, the thickness may suitably be decided from the range of, for example, 0.1 to 0.4 mm depending on the material of the alloy plate strip and the desired resistance. If the thickness is less than 0.1 mm, the strength required for a resistor cannot be given, and, for example, the resistor may disadvantageously be bent. Further, the resistor may not be properly mounted on a circuit board at a predetermined position. If the thickness is more than 0.4 mm, the cutting dimensional accuracy in step (D) and the productivity may be lowered.

The predetermined width may usually be selected so as to be approximately the longitudinal length of the final product chip resistor.

The alloy plate strip may be prepared, for example, by repeating rolling and annealing of a desired alloy ingot by conventional methods into a predetermined thickness, and cutting the rolled ingot into strips of a predetermined width.

According to the manufacturing method of the present invention, next, step (B) of forming an insulating protective film in a predetermined width longitudinally along the middle of the upper and lower faces of the alloy plate strip is performed.

The insulating protective film may be formed by screen printing an ordinary insulating protective material, such as an epoxy resin. Prior to the formation of the insulating protective film, usually the surface of the alloy plate strip prepared in step (A) is degreased and roughened for improving adhesion of the protective film. After the protective film is printed, the alloy plate strip is baked usually at 150 to 250° C. for fixing the protective film. If an oxide film is formed on the surface of the alloy plate strip during baking, it may preferably be removed by etching or the like process.

The thickness of the insulating protective film, after the baking mentioned above, may suitably be selected from the range of usually 15 to 25 μm. If the thickness is less than 15 μm, the strength of the film may not be sufficient as a protective film. If the thickness is more than 25 μm, the dimensional precision of the screen-printed pattern of the protective film may be lowered. Further, the thickness may vary widely between electrodes, and the distribution of the appearance resistance may vary widely.

The width of the insulating protective film decides the width of the surface and back electrodes to be discussed later, and may be utilized for adjusting resistance. By increasing the width of the insulating protective film, i.e., by reducing the width of the surface and back electrodes, the resistance may usually be increased, whereas in reverse, the resistance may be lowered.

According to the manufacturing method of the present invention, next, step (C) of forming an electrode layer composed of integrated surface, back, and end electrodes, along both sides of the protective film by electroplating is performed.

In step (C), by employing electroplating, the electrode layer may be formed substantially in a uniform thickness over the surface of the alloy plate strip where the insulating protective film is not formed in step (B).

In the formation of the electrode layer, for improving adhesion of the electrode layer, metal plating for electrodes may usually be preceded by strike plating, so that the electrode layer may be formed in a plurality of layers. Further, by performing the electroplating through panel plating, the thickness of each layer in the parts corresponding to the surface, back, and end electrodes may be made substantially uniform, which improves reliability of the electrodes.

It is usually preferred that the electrode layer is thicker than or approximately the same thickness as the insulating protective film in order to fulfill the functions such as good solderability of the electrode and a reduced resistance.

In the formation of the electrode layer in step (C), in particular, when a copper based alloy such as a copper-manganese-tin based alloy or an iron-chromium based alloy mentioned above is used for the alloy plate strip, it is most preferred to panel plate nickel strike plating, copper plating, nickel plating, and tin plating in this order in order to improve adhesion of the electrode layer and to prevent lowering of the product yield caused by peeling of the electrode layer upon cutting in step (D). If copper or gold strike plating is used as the strike plating, the electrode is more likely to be peeled in step (D). Without the final tin plating, in mounting the resulting resistor by solder reflow, the solder wettability may be lowered. Without the nickel plating between the copper plating and the tin plating, the copper plating may be dispersed during mounting to deteriorate the reliability of the electrode.

The plating bath and the plating conditions for each plating may suitably be selected. For example, nickel strike plating may be performed using a nickel chloride bath and hydrochloric acid at high electric current in a short time. The nickel plating following the copper plating may be performed using a watts nickel bath.

According to the manufacturing method of the present invention, next, step (D) of cutting the alloy plate strip coated with the protective films and the electrode layers in step (C) transversely in predetermined lengths is performed to thereby obtain desired rectangular plate type chip resistors.

In step (D), by adjusting the cutting length, the resistance of the resulting resistor may be adjusted. Usually, by increasing the cutting length, the resistance may be lowered, whereas by decreasing the cutting length, the resistance may be increased.

Accordingly, by adjusting the thickness of the alloy plate strip in step (A), the width of the protective film formed in step (B), and the cutting length in step (D), the resistance may be controlled to fall within a predetermined range, so that formation of any slit or the like in the resistive body, which is conventionally required for adjusting the resistance, is not needed.

Steps (A) to (D) discussed above will now be explained briefly below with reference to the drawings. FIG. 1 is a schematic explanatory view for explaining each step of the manufacturing method according to the present invention, wherein FIG. 1(A) shows a resistive alloy plate strip 10 provided in step (A).

FIG. 1(B) shows one insulating protective film 11*a* formed in a predetermined width longitudinally along the middle of the upper face of the alloy plate strip 10, and one insulating protective film 11*b* formed in a predetermined width longitudinally along the middle of the lower face of the alloy plate strip 10, in step (B).

Figure 2:
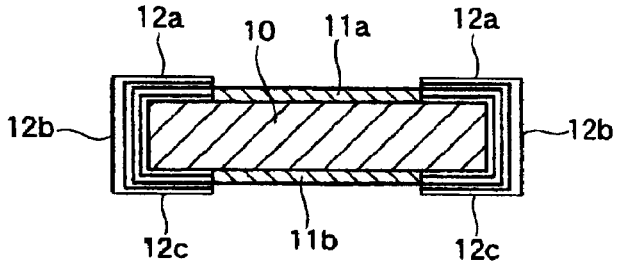
FIG. 2 is a sectional view taken in X-X plane in FIG. 1(C).

FIG. 1(C) shows electrode layers composed of integrated surface electrode 12*a*, back electrode 12*c*, and end electrode 12*b*, and formed uniformly along both sides of the protective film (11*a*, 11*b*) by electroplating. FIG. 2 is a sectional view taken in the X-X plane in FIG. 1(C).

According to the method of the present invention, step (D) is performed by cutting sequentially the alloy plate strip 10 coated with the protective films (11*a*, 11*b*) and the electrode layers 12 as shown in FIGS. 1(C) and 2 transversely in predetermined lengths as shown by the dash-dot lines in FIG. 1(C), to thereby obtain the desired rectangular plate type chip resistors.

In FIG. 2, the electrode layer 12 is shown to consist of four layers, which may be, for example, a nickel strike plating layer, a copper plating layer, a nickel plating layer, and a tin plating layer in this order from the inside to the outside. The electrode layer is not necessarily composed of four layers.

The rectangular plate type chip resistor according to the present invention has, for example as shown in FIG. 2, the insulating protective film (11*a*, 11*b*) on upper and lower faces of the resistive alloy plate 10, and the electrode portion 12 which is provided on both sides of the protective film (11*a*, 11*b*) and composed of integrated surface electrode 12*a*, back electrode 12*c*, and end electrode 12*b* formed in layers of a substantially uniform thickness. As discussed above, this chip resistor has been manufactured with the resistance being control led according to the method of the present invention, and thus does not have any slit or slot for adjusting the resistance.

EXAMPLES

The present invention will now be explained in more detail with reference to Examples, which do not limit the present invention.

Example 1

<Manufacture of Resistor of Desired Resistance 1 mΩ>

Resistive copper-manganese-tin (Cu—Mn—Sn) alloy plate strips (volume resistivity 0.30 μΩ·m), which had been adjusted to the length of about 30 cm, the width of 6.3 mm±0.25 mm, and the thickness of 0.23±0.07 mm, were provided. The alloy plate strips were subjected in advance to degreasing with a persulfate type liquid and roughening for improving adhesion of the protective film to be discussed later.

Next, an insulating protective film was screen printed along the middle of the upper and lower faces of each alloy plate strip as shown in FIG. 1(B) so as to have a width of 1.9 mm±0.25 mm and a thickness of about 20 μm, baked at 200° C., and subjected to removal of an oxide film.

Each of the resulting alloy plate strip was subjected to nickel strike plating at a current density of 6 A/dm$^2$ in a Wood's bath at 20° C. containing 240 g/L of nickel chloride and 100 ml/L of concentrated hydrochloric acid for 5 minutes. As a result, a nickel strike plating layer of about 3 μm thick was formed generally uniformly over the surface portions of each alloy plate strip where the protective film had not been formed. Then copper electroplating, nickel electroplating, and tin electroplating were successively performed by routine methods to form over the nickel strike plating layer an about 40 μm thick copper plating layer, an about 5 μm thick nickel plating layer, and an about 5 μm thick tin plating layer, so that each portion corresponding to surface, back, and end electrodes had a uniform thickness.

Next, each alloy plate strip coated with the protective films and the electrode layers was cut in lengths of 3.2 mm±0.25 mm at the positions shown by the dash-dot lines in FIG. 1(C), to thereby obtain a number of rectangular plate type chip resistors having the desired resistance of 1 mΩ. Upon cutting in Example, no peeling of the electrode layers was observed at all, which indicated excellent adhesion of the electrode layers.

Each rectangular plate type chip resistor thus obtained was subjected to the following measurements.

TCR Measurement

Ten of the chip resistors thus obtained were selected at random. The resistance of each selected resistor at 25° C., −55° C., and 125° C. was measured using AX-1152B DC Low-Ohm METER manufactured by ADEX Corporation, and the TCR at each temperature was calculated according to the following formulae. The results are shown in Table 1.

$$(\text{TCR at } -55^\circ\text{ C.})=\{[(\text{resistance at } -55^\circ\text{ C.})-(\text{resistance at } 25^\circ\text{ C.})]/(\text{resistance at } 25^\circ\text{ C.})\}\times(1/(-55-25))\times10^6$$

$$(\text{TCR at } 125^\circ\text{ C.})=\{[(\text{resistance at } 125^\circ\text{ C.})-(\text{resistance at } 25^\circ\text{ C.})]/(\text{resistance at } 25^\circ\text{ C.})\}\times[1/(125-25)]\times10^6$$

Load-Life Measurement

Ten of the chip resistors thus obtained were selected at random, and the resistance of each resistor was measured as the initial value. Then the ten resistors were connected in series to a constant current source, and rated current of 31.6 A was carried at the ambient temperature of 70° C. ±3° C. for 298 hours, 500 hours, and 1000 hours. The resistance of each resistor after each period was measured, and the change from the initial value was obtained. The results are shown in Table 2.

Measurement of Change in Resistance

At the rated power of 1 W, voltages at an applied current of 1.001 A and at the rated current of 31.6 A were measured, resistance (measured voltage/current) was calculated, and the rate of change was obtained. The results are shown in Table 3.

TABLE 1

| Sample No. | Resistance at 25° C. (Ω) | Resistance at −55° C. (Ω) | TCR at −55° C. ($10^{-6}$/° C.) | Resistance at 125° C. (Ω) | TCR at 125° C. ($10^{-6}$/° C.) |
|---|---|---|---|---|---|
| 1 | 0.00099914 | 0.00099720 | 24.3 | 0.00099857 | −5.7 |
| 2 | 0.00099649 | 0.00099475 | 21.8 | 0.00099572 | −7.7 |
| 3 | 0.00099625 | 0.00099471 | 19.3 | 0.00099520 | −10.5 |
| 4 | 0.00099438 | 0.00099193 | 30.8 | 0.00099428 | −1.0 |
| 5 | 0.00099870 | 0.00099630 | 30.0 | 0.00099829 | −4.1 |
| 6 | 0.00099346 | 0.00099088 | 32.5 | 0.00099341 | −0.5 |
| 7 | 0.00099200 | 0.00098946 | 32.0 | 0.00099182 | −1.8 |
| 8 | 0.00099862 | 0.00099553 | 38.7 | 0.00099899 | 3.7 |
| 9 | 0.00100260 | 0.00100148 | 14.0 | 0.00100109 | −15.1 |
| 10 | 0.00099419 | 0.00099336 | 10.4 | 0.00099235 | −18.5 |

TABLE 2

| Sample No. | Change in Resistance after 298 Hours (%) | Change in Resistance after 500 Hours (%) | Change in Resistance after 1000 Hours (%) |
|---|---|---|---|
| 1 | −0.452 | −0.563 | −0.272 |
| 2 | −0.747 | −0.854 | −0.293 |
| 3 | −0.408 | −0.515 | −0.688 |
| 4 | −0.424 | −0.546 | −0.580 |
| 5 | −0.563 | −0.712 | −0.278 |
| 6 | −0.730 | −0.868 | −0.681 |
| 7 | −0.554 | −0.697 | −0.531 |
| 8 | −0.664 | −0.755 | −0.957 |
| 9 | −0.581 | −0.708 | −0.512 |
| 10 | −0.690 | −0.807 | −0.494 |

TABLE 3

| Applied Current (A) | Measured Voltage (mV) | Measured Voltage/ Applied Current Resistance (mΩ) | Rate of Change in Resistance (%) |
|---|---|---|---|
| 1.001 | 1.0080 | 1.006993 | −0.20 |
| 31.6 | 31.7558 | 1.004930 | |

Example 2

<Manufacture of Resistor of Desired Resistance 10 mΩ>

Resistive iron-chromium-aluminum (Fe—Cr—Al) alloy plate strips (volume resistivity 1.30 μΩ·m), which had been adjusted to the length of about 30 cm, the width of 6.3 mm±0.25 mm, and the thickness of 0.20 mm±0.07 mm, were provided. The alloy plate strips were subjected in advance to degreasing with a ferric chloride type liquid and roughening for improving adhesion of the protective film to be discussed later.

Next, an insulating protective film was screen printed along the middle of the upper and lower faces of each alloy plate strip as shown in FIG. 1(B) so as to have a width of 4.3 mm±0.25 mm and a thickness of about 20 μm, baked at 200° C., and subjected to removal of an oxide film.

Each of the resulting alloy plate strip was subjected to nickel strike plating at a current density of 6 A/dm$^2$ in a Wood's bath at 20° C. containing 240 g/L of nickel chloride and 100 ml/L of concentrated hydrochloric acid for 5 minutes. As a result, a nickel strike plating layer of about 3 μm thick was formed generally uniformly over the surface portions of each alloy plate strip where the protective film had not been formed. Then copper electroplating, nickel electroplating, and tin electroplating were successively performed by routine methods to form over the nickel strike plating layer an about 40 μm thick copper plating layer, an about 5 μm thick nickel plating layer, and an about 5 μm thick tin plating layer, so that each portion corresponding to the surface, back, and end electrodes had a uniform thickness.

Next, each alloy plate strip coated with the protective films and the electrode layers was cut in lengths of 3.2 mm±0.25 mm at the positions shown by the dash-dot lines in FIG. 1(C), to thereby obtain a number of rectangular plate type chip resistors having the desired resistance of 10 mΩ. Upon cutting in Example, no peeling of the electrode layers was observed at all, which indicated excellent adhesion of the electrode layers.

Each rectangular plate type chip resistor thus obtained was subjected to the TCR measurement, load-life measurement, and measurement of change in resistance in the same way as in Example 1. The results are shown in Tables 4 to 6.

Here, the rated current in the load-life measurement was 10 A, and the 298 hour current carrying period in Example 1 was replaced with a 250 hour current carrying period. In the measurement of change in resistance, at the rated power of 1 W, voltages at an applied current of 1.003 A and at the rated current of 10 A were measured, the resistance was calculated, and the rate of change was obtained.

TABLE 4

| Sample No. | Resistance at 25° C. (Ω) | Resistance at −55° C. (Ω) | TCR at −55° C. ($10^{-6}$/° C.) | Resistance at 125° C. (Ω) | TCR at 125° C. ($10^{-6}$/° C.) |
|---|---|---|---|---|---|
| 1 | 0.0099844 | 0.0099362 | 60.3 | 0.0100516 | 67.3 |
| 2 | 0.0100050 | 0.0099536 | 64.2 | 0.0100773 | 72.3 |
| 3 | 0.0099978 | 0.0099412 | 70.8 | 0.0100756 | 77.8 |
| 4 | 0.0099963 | 0.0099454 | 63.6 | 0.0100677 | 71.4 |
| 5 | 0.0100197 | 0.0099628 | 71.0 | 0.0100976 | 77.7 |
| 6 | 0.0099925 | 0.0099532 | 49.2 | 0.0100499 | 57.4 |
| 7 | 0.0100430 | 0.0100073 | 44.4 | 0.0100969 | 53.7 |
| 8 | 0.0100120 | 0.0099760 | 44.9 | 0.0100634 | 51.3 |
| 9 | 0.0099681 | 0.0099472 | 26.2 | 0.0100025 | 34.5 |
| 10 | 0.0099958 | 0.0099652 | 38.3 | 0.0100414 | 45.6 |

TABLE 5

| Sample No. | Change in Resistance after 250 Hours (%) | Change in Resistance after 500 Hours (%) | Change in Resistance after 1000 Hours (%) |
|---|---|---|---|
| 1 | −0.038 | −0.035 | −0.054 |
| 2 | −0.062 | −0.058 | −0.058 |
| 3 | −0.016 | −0.007 | −0.012 |
| 4 | −0.048 | −0.032 | −0.045 |
| 5 | −0.046 | −0.039 | −0.045 |
| 6 | −0.080 | −0.069 | −0.082 |
| 7 | −0.043 | −0.040 | −0.057 |
| 8 | −0.086 | −0.082 | −0.092 |
| 9 | −0.053 | −0.062 | −0.067 |
| 10 | −0.051 | −0.058 | −0.063 |

TABLE 6

| Applied Current (A) | Measured Voltage (mV) | Measured Voltage/ Applied Current Resistance (mΩ) | Rate of Change in Resistance (%) |
|---|---|---|---|
| 1.003 | 10.0678 | 10.03769 | 0.541 |
| 10 | 100.92 | 10.092 | |

What is claimed is:

1. A method for manufacturing rectangular plate type chip resistors comprising the steps of:

(A) providing a resistive alloy plate strip of predetermined width and thickness, (B) forming an insulating protective film of a predetermined width longitudinally along the middle of upper and lower faces of said alloy plate strip, (C) forming an electrode layer composed of integrated surface, back, and end electrodes, along both sides of the protective film by electroplating, and (D) cutting the alloy plate strip coated with the protective films and the electrode layers in step (C) transversely in predetermined lengths, wherein a resistance is controlled to be within a predetermined range by adjusting said thickness of the alloy plate strip in step (A), said width of the protective film formed in step (B), and said cutting length in step (D).

2. The method according to claim 1, wherein said resistive alloy plate strip is a copper based alloy or iron-chromium based alloy plate strip.

3. The method according to claim 1, wherein said step (C) of forming an electrode layer is performed by nickel strike plating, copper plating, nickel plating, and tin plating through panel plating in this order.

4. A rectangular plate type chip resistor manufactured by a method according to claim 1, comprising a resistive alloy plate, an insulating protective film on upper and lower faces of said alloy plate, and an electrode portion formed in layers of a substantially uniform thickness on both sides of said protective film and composed of integrated surface, back, and end electrodes, wherein said chip resistor is free of any slit or slot for adjustment of a resistance.

5. The rectangular plate type chip resistor according to claim 4, wherein a thickness of the resistive alloy plate strip is 0.1 to 0.4 mm, and a resistance of the resulting resistor is 0.5 to 30 mΩ.

* * * * *